US008398110B2

(12) United States Patent
Morin

(10) Patent No.: US 8,398,110 B2
(45) Date of Patent: Mar. 19, 2013

(54) BACK-COUNTRY SKI BINDING

(76) Inventor: Jeannot Morin, Intervale, NH (US)

( * ) Notice: Subject to any disclaimer, the term of this patent is extended or adjusted under 35 U.S.C. 154(b) by 121 days.

(21) Appl. No.: 13/018,642

(22) Filed: Feb. 1, 2011

(65) Prior Publication Data

US 2011/0187082 A1 Aug. 4, 2011

Related U.S. Application Data

(60) Provisional application No. 61/300,206, filed on Feb. 1, 2010.

(51) Int. Cl.
*A63C 9/00* (2006.01)

(52) U.S. Cl. ..... 280/614; 280/617; 280/618

(58) Field of Classification Search ..... 280/614, 280/615, 618, 611, 613, 617
See application file for complete search history.

(56) References Cited

U.S. PATENT DOCUMENTS

| | | | | |
|---|---|---|---|---|
| 4,002,354 | A * | 1/1977 | Ramer | 280/614 |
| 4,353,575 | A * | 10/1982 | Brice | 280/614 |
| 4,513,988 | A * | 4/1985 | Svoboda | 280/615 |
| 5,318,320 | A * | 6/1994 | Ramer | 280/614 |
| 5,360,229 | A * | 11/1994 | Arduin et al. | 280/617 |
| 5,560,633 | A * | 10/1996 | McGowan | 280/614 |
| 5,735,541 | A | 4/1998 | Fritshi et al. | |
| 6,308,979 | B1 | 10/2001 | Ludlow | |
| 6,371,506 | B1 | 4/2002 | DeNicola | |
| 6,431,578 | B2 | 8/2002 | Pedersen et al. | |
| 6,454,291 | B1 | 9/2002 | Hillairet et al. | |
| 6,923,465 | B2 | 8/2005 | DuBuque | |
| 7,246,812 | B1 * | 7/2007 | Ayliffe | 280/615 |
| 2008/0290630 | A1 | 11/2008 | Pupko | |
| 2008/0309053 | A1 | 12/2008 | Mangold et al. | |
| 2010/0001491 | A1 | 1/2010 | Schlegel et al. | |

FOREIGN PATENT DOCUMENTS

| | | | |
|---|---|---|---|
| EP | 1 971 408 | B1 | 9/2008 |
| WO | 2007/079604 | A1 | 7/2007 |
| WO | 2008/083511 | A1 | 7/2008 |

OTHER PUBLICATIONS

The New Diamir Freeride Plus. http://www.diamir.com/en/produkte/freerideplus.html?mid=produkte&sid=freerideplus. 1 page.

* cited by examiner

*Primary Examiner* — Hau Phan
(74) *Attorney, Agent, or Firm* — Davis & Bujold, PLLC

(57) ABSTRACT

A slope compensation mechanism for automatically adapting an angle between a ski boot and a ski to a slope, including a tower mechanism having a tower base assembly mounted to the ski and a tower pivot mechanism rotatably and slidably mounted to the tower base assembly. A resilient pivot mechanism allows the tower pivot mechanism to rotate and to axially move with respect to the tower base assembly and a boot mounting beam engages with elevation angle catches corresponding to ranges of angles of a slope. A slope angle adaptation mechanism acting between the tower base assembly and the tower pivot mechanism determines a slope index angle corresponding to a slope being traversed and maintains the tower pivot mechanism at the slope index angle.

13 Claims, 12 Drawing Sheets

34
34V
34P
34U
5.5°
16.5°

26
22
26
28C
28B
28S
28P
34U
34S
34V
24
32P
32A
32S
32X
32Y
32R
34P
24S
16A
16

34N
34M
34L
0°
90°

BACK-COUNTRY SKI BINDING

FIELD OF THE INVENTION

The present invention relates to a ski binding for back country skiing and, in particular, a ski binding that is adaptable to the requirements of cross country skiing, including assisting in up-hill travel, and down-hill skiing according to both conventional and telemark methods.

BACKGROUND OF THE INVENTION

Skiing is and long has been a popular sport, of which the two most familiar and popular forms are cross country skiing and downhill skiing, wherein cross country skiing generally involves travel on specially laid out trails across relatively level terrain with a walking or striding motion and with any travel up and down slopes being limited to relatively gentle slopes. In contrast, down-hill skiing is essentially specialized, as the name implies, to gravity powered travel down slopes of varying degrees of steepness.

As is well known, the equipment used in the two forms of the sport reflect these basic differences between these forms of skiing and the differences between the equipment used in each effectively means that the equipment for one form of skiing cannot be used in the other. For example, downhill boots and bindings are designed solely to transport the skier down a relatively steep slope. For this reason, downhill boots and bindings are designed to rigidly secure the boot and the user's foot in one position relative to the ski so that the ski essentially becomes an extension of the wearer's foot, and to resist very high lateral forces in doing so. For this reason, in turn, the boot is a rigid structure that allows almost no motion of the wearer's foot or leg relative to the boot and the binding rigidly secures the boot to the ski so as to allow no motion between the boot and the wearer's foot and the ski.

It is therefore apparent that downhill boots and bindings are completely unsuitable for cross country skiing because they lock the wearer's foot into a position flat to the ski and do not allow the foot and leg motions necessary for the desired walking or striding motion. Downhill skis and bindings are in fact unsuited for moving any significant distance on even a level surface, and are even less suited for traveling any distance on any form of uphill slope, such as often encountered in cross country skiing, because the binding tends to force the wearer into a backward tilted stance.

In contrast to downhill boots and bindings, cross country boots and bindings must be and are designed to allow the wearer to move with a relatively normal walking or striding motion. For this reason, a cross country ski boot is generally shoe-like and engages the cross country ski binding by means of a toe catch/pivot mechanism that includes a horizontal, cross-ski pin in the ski binding. This mechanism secures the boot to the ski at the toe of the boot while allowing the heel to rise and fall in a vertical arc centered at the toe of the boot and aligned with the ski, thereby allowing the user's foot to generally move, relative to the ski, in a normal striding or walking motion.

In a cross country binding, however, the only significant connection between the boot and the ski is the toe catch/pivot mechanism and, for this reason, the boot and binding often include a ridge and groove arrangement that engage when the boot is flat to the ski to thereby provide some degree of support against lateral forces. Despite this additional support, however, cross country skis and bindings are generally unsuitable for any significant degree of downhill skiing because the rib and groove readily disengage with any vertical force on or motion of the heel and the lateral support provided is generally inadequate to resist the lateral forces encountered in down-hill skiing. Also, like downhill skis and bindings, cross country skis have very limited uphill capabilities because the sole fixed connection between the ski and the wearer is the toe hinge, so that when the skier is traveling up a slope the binding allows the tip of the ski to freely rise relative to the wearer's foot so that the wearer is essentially supporting their entire weight on their toes.

The inherent limitations of downhill and conventional cross country bindings present significant problems for skiers who wish to engage in a third type of skiing generally referred to generally as "back country" skiing. Back country skiing is essentially cross country skiing extended to areas off of groomed trails and into areas presenting significant uphill and downhill slopes. Back country ski equipment must therefore be efficient at the basic striding or walking modes of cross country skiing, and must also provide significant capabilities for both downhill skiing and uphill travel.

It should be noted that there have been some previous attempts to provide either a form of ski boot and binding or a method of skiing that is at least somewhat usable in both cross country and downhill skiing. For example, there is a form of cross country skiing referred to as "Telemark" skiing wherein a cross country binding is used in downhill skiing which requires that the skier position the skis with one ski positioned ahead of or behind the other when traveling downhill and that the skier manage turns by specific and limited methods for shifting the skier's weight and the positions of the skis. While the "Telemark" method is occasionally used by cross country skiers when faced with a steeper than usual downhill slope, the method is relatively unpopular among downhill skiers because the specific maneuvers with the skis required of this form of skiing and the inherent limitations of the cross country bindings, both of which severely limit the maneuvers that can be performed compared to downhill skis. In addition, Telemark skiing has characteristics and methods that are explicitly different from both cross country skiing and downhill skiing and is thereby an additional form of skiing that must be learned and practiced in its own right.

Another attempted solutions of the prior art include various forms of hybrid bindings, a typical example of which is the Freeride binding offered by Diamir products of Switzerland. The Freeride binding is essentially a conventional downhill binding that is split into a toe part and a heel part wherein the toe part is hinged to the ski in the manner of a cross country binding and the heel part can be disengaged from the ski boot to allow the heel to rotate upward and downward around the toe hinge in the manner of a cross country binding. This form of hybrid binding is therefore essentially a downhill binding that can be adjusted to provide some of the characteristics of a cross country ski, but still does not provide a satisfactory solution to the above discussed problems. For example, because this is essentially a modified downhill binding and is primarily intended for downhill travel, the binding uses the conventional rigid downhill boot, which does not allow the desired motion of the ankle joint desired for a comfortable walking or striding motion. In addition, and again because the sole connection between the wearer and the ski when traveling in cross country mode is the toe hinge, the wearer is still forced to travel on their toes when going up a slope, as in the case of cross country skis. Also, the wearer is required to stop and engage or disengage the heel mechanism for each change in the slope.

The present invention as described herein below provides solutions to these and other problems of the prior art.

SUMMARY OF THE INVENTION

The present invention is directed to a ski binding and a slope compensation mechanism for automatically adapting an angle between a ski boot and a plane of a ski to a slope being traversed by a skier. In one present embodiment of the invention, the ski and boot assembly includes a mounting beam for supporting the ski boot and wherein the mounting beam includes a boot attachment mechanism for securing the boot to the mounting beam and is rotatingly mounted to a toe base on the ski so that a heel end of the mounting beam and a heel end of the ski boot are rotatable upward and downward about the toe base during a stride of a skier. In other embodiments, the boot may be attached directly to the ski by a toe pivot with the heel of the boot engaging with the slope compensation mechanism by means of an adapter located on the heel of the boot.

According to the present invention the ski binding and the slope compensation mechanism include a tower mechanism which includes a tower base assembly mounted to the ski and a tower pivot mechanism rotatably and slidably mounted to the tower base assembly. A resilient pivot mechanism acts between the tower base assembly and the tower pivot mechanism and allows the tower pivot mechanism to rotate and to axially move with respect to the tower base assembly during the stride of the skier. The tower pivot mechanism includes a plurality of elevation angle catches for engaging with the mounting beam, each elevation angle catch corresponding to one of a set of slope index angles corresponding to a range of angles of a slope being traversed by the skier wherein an elevation angle catch engaged by the beam adapter during a stride is determined by the angle of a slope being traversed. The tower mechanism further includes a slope angle adaptation mechanism acting between the tower base assembly and the tower pivot mechanism for determining a slope index angle corresponding to a slope being traversed and maintaining the tower pivot mechanism at the slope index angle during at least a part of a stride when a skier's weigh is imposed on the beam.

In a present embodiment of the invention, the tower pivot mechanism includes first and second tower sidewall structures connected by a tower pivot body, and the tower base assembly includes a tower base attachable to an upper surface of the ski and a tower pivot support extending above the tower base and beneath the tower pivot body.

The resilient pivot mechanism includes height adaptation slots located on an interior surface of and extending parallel to a vertical axis of the tower sidewall structures of the tower pivot mechanism, and a tower pivot pin extending transversely with respect to and supported by the tower pivot support with ends of the tower pivot pin engaging in the height adaptation slots. The tower pivot pin and height adaptation slots allow the tower pivot mechanism to rotate with respect to the tower pivot support and to move axially between a lowest and highest tower pivot mechanism location. A resilient bias mechanism includes a bias piston having a lower end pivoting on the tower pivot pin and an upper end extending into a bias cylinder located in tower pivot body and a bias spring engaged between the tower pivot body and the bias piston, resiliently biasing the tower pivot mechanism upward, whereby the tower pivot mechanism is urged resiliently upward with respect to the tower base assembly during a part of a skier's stride when the skier's weight is removed from the tower pivot mechanism and is moved downward toward the tower base assembly when the skier's weight is imposed on the tower pivot mechanism.

The ski binding and the slope compensation mechanism further include a pendulum mechanism for determining a slope index angle corresponding to a slope being traversed, the pendulum mechanism including a pendulum pin extending horizontally and transversely through the tower, the pendulum pin being movable along the pendulum slots to assume a position along the pendulum slots corresponding with an angle of a slope being traversed. Each pendulum slot includes a tower angle notch located in a lower side of the pendulum slot, each tower angle notch having sloping sides and an apex oriented away from and radially aligned with the tower pivot pin and a width at the pendulum slot corresponding to at least a movement of the pendulum pin along the pendulum slots corresponding to sequentially adjacent index angles. Upward movement of the tower pivot mechanism by the resilient bias mechanism when the skier's weight is removed from the tower pivot mechanism will cause engagement of the tower angle notch sides with the pendulum pin and rotation of the tower pivot mechanism to a slope index angle relative to the tower base assembly corresponding to the angle of the slope being traversed.

In a presently preferred embodiment of the invention, each pendulum slot includes a plurality of sequentially intersecting linear pendulum slot sections having successive upward angles relative to a plane of the ski corresponding to successive ones of the plurality of index slope angles. In one described embodiment, the plurality of linear pendulum slot angles includes at least a first linear pendulum slot section extending upward relative to the plane of the ski at an angle corresponding to a first one of the plurality of index slope angles and a second linear pendulum slot section extending upward relative to the plane of the ski at an angle corresponding to a second one of the plurality of index slope angles The ski binding and slope adaptation mechanism further includes a clutch mechanism located in the tower base assembly wherein the clutch mechanism is actuated by upward movement of the tower pivot mechanism by the resilient bias mechanism when the skier's weight is removed from the tower pivot mechanism, whereupon the clutch mechanism engages and restrains the pendulum pin at a position along the pendulum slots corresponding to the slope index angle. The clutch mechanism is deactuated by downward movement of the tower pivot mechanism against the resilient bias mechanism when the skier's weight is imposed on the tower pivot mechanism to disengage from the pendulum pin and allow movement of the pendulum pin along the pendulum slot.

In a presently preferred embodiment, the clutch mechanism includes a clutch surface resiliently biased in an upward direction toward the pendulum pin, an angle index ratchet mounted on the clutch surface for engaging with and restraining the pendulum pin, and at least one clutch actuation surface engaged by a lower surface of the tower structure to deactuate the clutch mechanism when the tower pivot mechanism is moved downward against the resilient force of the resilient bias mechanism when the skier's weight is imposed on the tower pivot mechanism.

In present embodiments of a binding of the present invention, the binding may further include an end cap located at a heel end of the beam and including an end cap adapter for mechanically interfacing the beam with the elevation angle catches of the tower pivot mechanism. In other embodiments, the toe of the boot may be pivotably secured directly to the ski by a toe pivot mechanism and an end cap adapter or equivalent thereof may be mounted directly onto the heel of the boot.

The binding may also include a downhill skiing lock mechanism for securing the beam to the tower mechanism with the beam in a position parallel to the ski wherein the downhill skiing lock mechanism includes an end cap adapter mounted on a heel end of the beam, adapter lock arms extending transversely outwards from the end cap adapter and a downhill lock slot located on inner surfaces of sidewall structures of the tower pivot mechanism. The downhill lock slots are each L-shaped and engage with the adapter lock arms to secure each adapter lock arm in the corresponding downhill lock slot when the tower pivot structure is rotated to a position parallel with a ski.

BRIEF DESCRIPTION OF THE DRAWINGS

The invention will now be described, by way of example, with reference to the accompanying drawings in which.

DETAILED DESCRIPTION OF THE INVENTION

A. Introduction and General Description of the Structure and Mechanisms of a Binding 10

Figure 1:
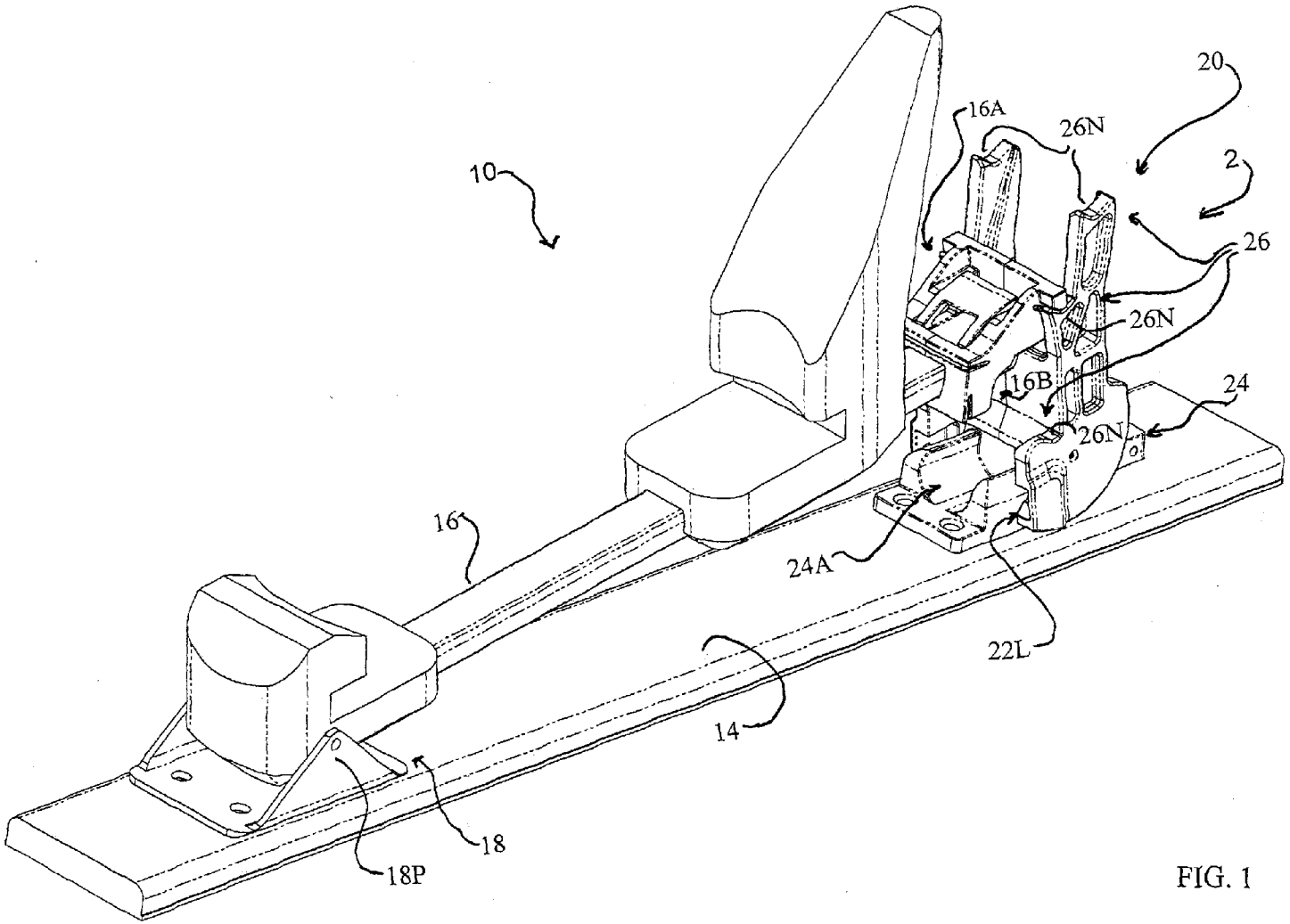
FIG. 1 is a diagrammatic isometric view of a ski binding of the present invention.
Figure 2:
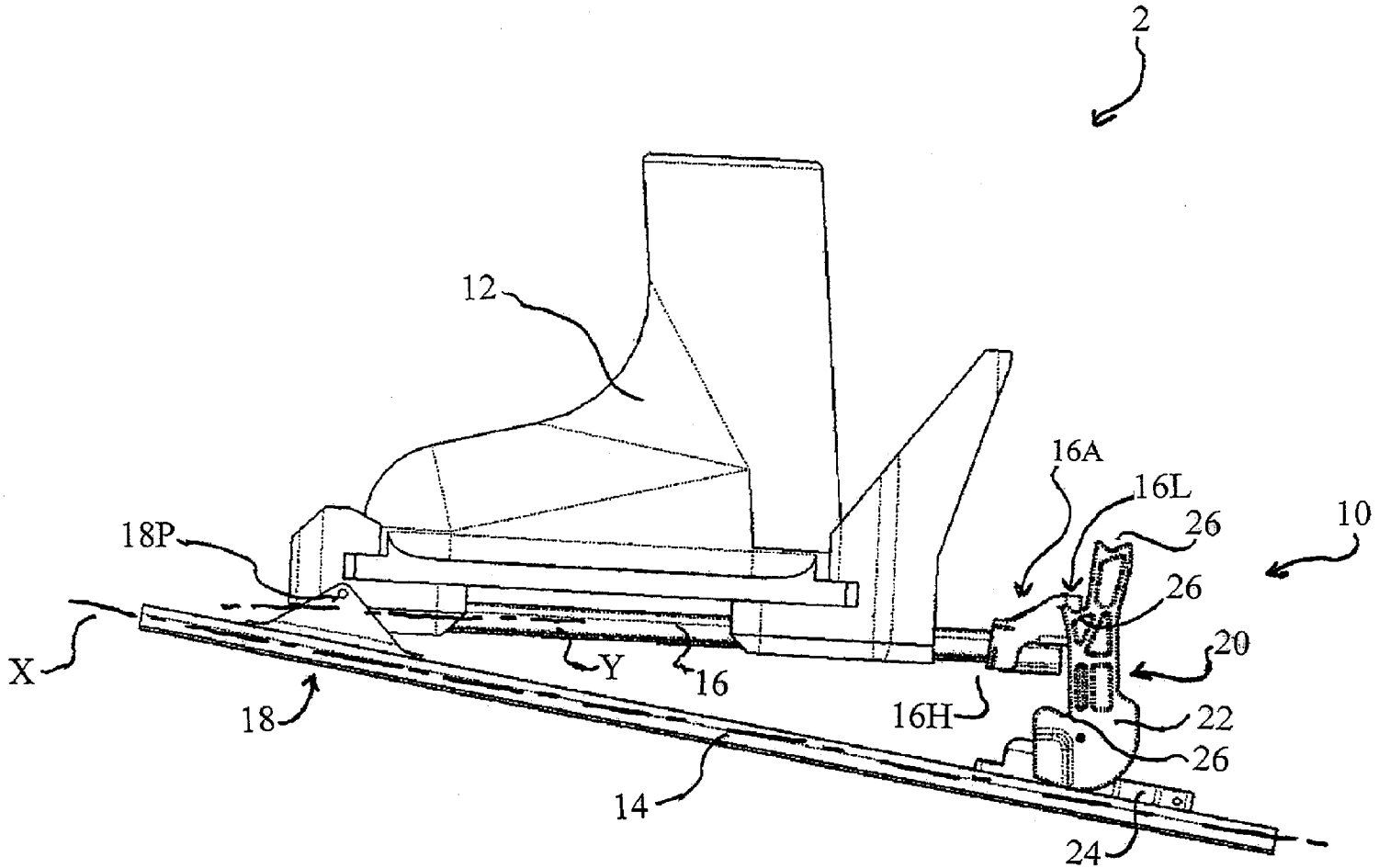
FIG. 2 is a diagrammatic side view of a ski binding of the present invention.

Referring to FIGS. 1 and 2, therein are respectively shown a diagrammatic isometric view and a diagrammatic side view of a ski binding 10 of the present invention and the mounting of a ski boot 12 to a ski 14. It will be noted that the means by which a ski boot 12 is engaged with binding 10 is not shown in detail as, while there is a high degree of standardization among ski boots, or at least within a given type of ski boot, downhill or cross country, the specifics of this mechanism will vary depending on the specific design of the ski boot 12. The means and methods by which a conventional ski boot 12 may be mounted or adapted to a ski binding 10 of the present invention will be apparent to those of ordinary skill in the relevant arts, however, without further description.

As illustrated in FIGS. 1 and 2, a binding 10 of the present invention includes a mounting beam 16 that is pivotally mounted to a toe base 18 at toe end 16T of beam 16 by a horizontally oriented toe pivot pin 18P that extends horizontally with respect to the plane of ski 14 and transversely to the axis X of the ski 14. Mounting beam 16 can therefore rotate about toe pivot pin 18P in a vertical plane aligned along ski axis X in a manner generally similar to the toe hinge mechanism of a cross country ski. In other embodiments, however, the boot 12 may be mounted directly to the ski 14 by a toe pivot mechanism that is functionally equivalent to the toe mount 18 and toe pivot pin 18P, thereby eliminating the beam 16.

The present invention further includes a slope compensation mechanism 2 for automatically adapting an angle between a ski boot and a plane of a ski to a slope being traversed by a skier wherein the slope compensation mechanism 2 includes a tower assembly 20 that includes a tower pivot mechanism 22 mounted to the ski 14 by means of a tower base assembly 24 that is secured to the ski 14. As indicated, and as will be discussed in detail in the following, tower pivot assembly 20 engages with an end cap 16C mounted at heel end 16H of mounting beam 16 to control the range of angles between ski axis X and the axis Y of beam 16 as a skier strides along a slope or skies downhill and according to the mode of skiing being practiced by the wearer. In a presently preferred embodiment of the invention, and as shown in FIGS. 1 and 2 as well as in the following figures, end cap 16C engages with elevation angle catches 26 of tower pivot mechanism 22 by means of an end cap adapter 16A that is secured to end cap 16C and that, in a present embodiment, extends the width of tower pivot mechanism 22 to engage with corresponding notch regions 26N of elevation angle catches 26 at the two sides of tower pivot mechanism 22. In other embodiments of the present invention, such as embodiments not including a beam 16 but wherein the toe of the boot is pivoted directly to the ski by a toe pivot mounting functionally equivalent to a toe base 18 and toe pivot pin 18P, the end cap adapter 16A or a functional equivalent thereof may be mounted onto the heel of the boot 12.

As illustrated, a presently preferred embodiment of tower pivot mechanism 22 includes plurality of elevation angle catches 26, each of which corresponds to and determines a corresponding slope adjustment angle of the tower assembly 20. The embodiment illustrated in the figures includes three elevation angle catches 26 wherein each elevation angle catch 26 corresponds to one of a set of slope index angles wherein each slope index angle corresponds to a range of angles that may occur in a slope being traversed by a skier. In a presently preferred embodiment of the invention, there are three slope index angles 34L, 34M and 34N, shown and described in a following discussion pertaining to FIGS. 7A, 7D and 7E, wherein the first slope index angle 34L corresponds generally to a horizontal slope, the second slope index angle 34M corresponds generally to an intermediate slope angle, such as 5.5 degrees to 16.5 degrees, and the third slope index angle 34N corresponds to slope angles of greater than 16.5 degrees.

As indicated, and as will be discussed in detail in the following, tower pivot assembly 20 engages with an end cap adapter 16A mounted at heel end 16H of mounting beam 16 to control the range of angles between ski axis X and the axis Y of beam 16, as shown in FIG. 2, as a skier strides along a slope or skies downhill and according to the mode of skiing being practiced by the wearer. In a presently preferred embodiment of the invention, and as shown in FIGS. 1 and 2 as well as in the following figures, end cap 16C engages with elevation angle catches 26 of tower pivot mechanism 22 by means of an end cap adapter 16A that is secured to end cap 16C and that, in a present embodiment, extends the width of tower pivot mechanism 22 to engage with corresponding notch regions 26N of elevation angle catches 26 at the two sides of tower pivot mechanism 22. As illustrated, a presently preferred embodiment of tower pivot mechanism 22 includes plurality of elevation angle catches 26, each of which corresponds to and determines a corresponding range of possible slopes within the total range of slopes to which the binding 10 and slope compensation mechanism 2 may adapt.

According to the present invention, and as will be described in detail in the following, when the wearer is downhill skiing, tower assembly 20 engages with end cap adapter 16A, which is attached to end cap 16C at the rear end of mounting beam 16, so as to lock mounting beam 16 and thus the ski boot 12 into a position parallel with the ski 14 as in conventional downhill skiing. In cross country mode, however, tower assembly 20 operates to allow the toe of the boot 12 to rotate about the toe base 18 of binding 10 so as to permit the heel 16H of beam 16 and thus the heel of the ski boot to rise and fall with each stride, as in conventional cross country skiing.

As will be described in detail in the following, tower assembly 20 additionally operates in cross country mode to automatically and dynamically adapt the angle between beam axis B and ski axis A to the tower assembly 20 that includes a tower pivot mechanism 22 mounted to the ski 14 by means of a tower base assembly 24 that is secured to the ski 14. As indicated, and as will be discussed in detail in the following, tower pivot assembly 20 engages with an end cap 16C mounted at heel end 16H of mounting beam 16 to control the range of angles between ski axis X and the axis Y of beam 16 as a skier strides along a slope or skies downhill and according to the mode of skiing being practiced by the wearer.

In a presently preferred embodiment of the invention, and as shown in FIGS. 1 and 2 as well as in the following figures, end cap 16C engages with elevation angle catches 26 of tower pivot mechanism 22 by means of an end cap adapter 16A that is secured to end cap 16C and that, in a present embodiment, extends the width of tower pivot mechanism 22 to engage with corresponding notch regions 26N of elevation angle catches 26 at the two sides of tower pivot mechanism 22. As illustrated, a presently preferred embodiment of tower pivot mechanism 22 includes plurality of elevation angle catches 26, each of which corresponds to and determines a corresponding slope of a slope being traversed so that the wearer's foot is always supported in approximately a horizontal position as the wearer progresses up a slope.

Figure 3A:
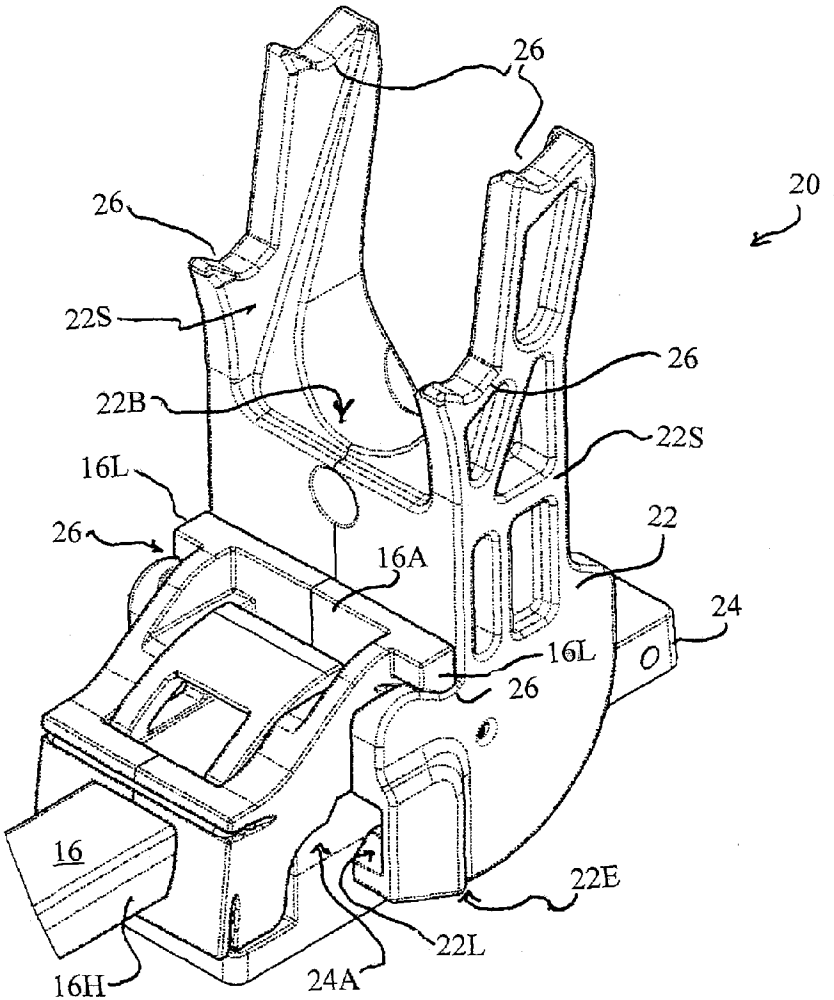
FIG. 3A is an enlarged isometric view of a binding according to the present invention.
Figure 3B:
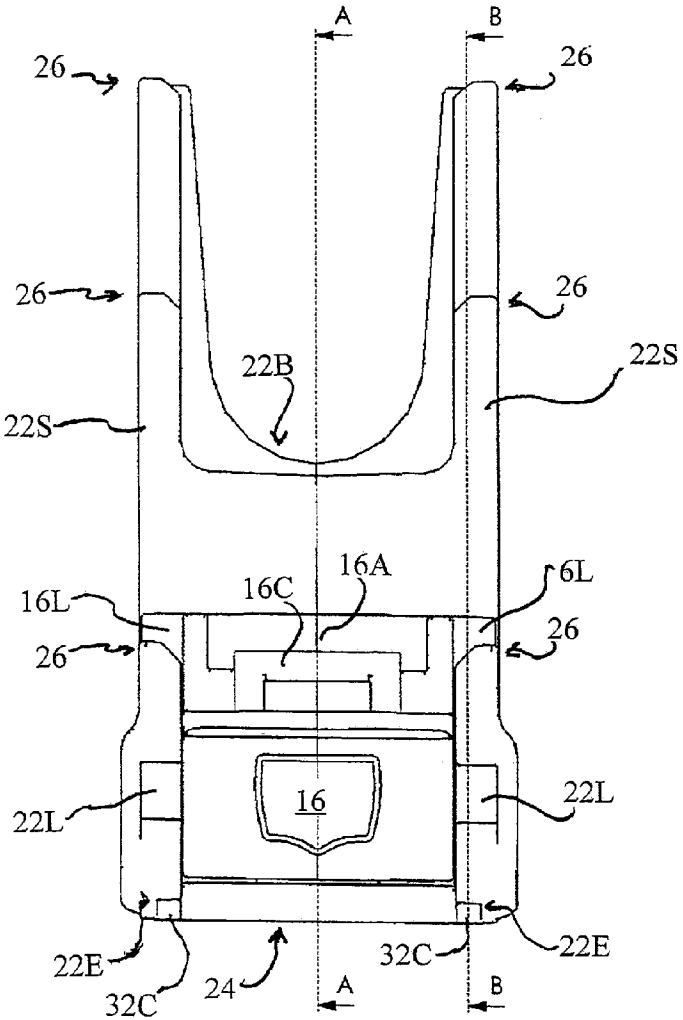
FIG. 3B is a front view of tower assembly of the present invention showing sectional planes A-A and B-B appearing in following drawings.

Referring now to FIGS. 3A and 3B in preparation and orientation for the following discussions, therein are respectively shown an enlarged isometric view of a binding 10, and in particular slope compensation mechanism 2 including tower assembly 20 with tower base assembly 24 and beam 16 with beam end cap 16C and end cap adapter 16A, and a front cross sectional view of tower assembly 20. The following discussions of a binding 10 and slope compensation mechanism 2 of the present invention will include and refer to side views and side sectional views of tower assembly 20 with tower base assembly 24 and beam 16 with beam end cap 16C and end cap adapter 16A and the component interior elements thereof. As illustrated in FIG. 3B, the side sectional views of tower assembly 20 with tower base assembly 24 and beam 16 with beam end cap 16C and end cap adapter 16A will be represented with respect to two sectional planes, which are indicated in FIG. 3A as sectional planes A-A and B-B. As will be seen in the following discussions, sectional plane A-A is taken along the centerline axis of tower assembly 20 and sectional B-B is taken along a plane that will show a side view of tower base assembly 24 and a sectional view of the outer plane of tower pivot mechanism 22.

Figure 4:
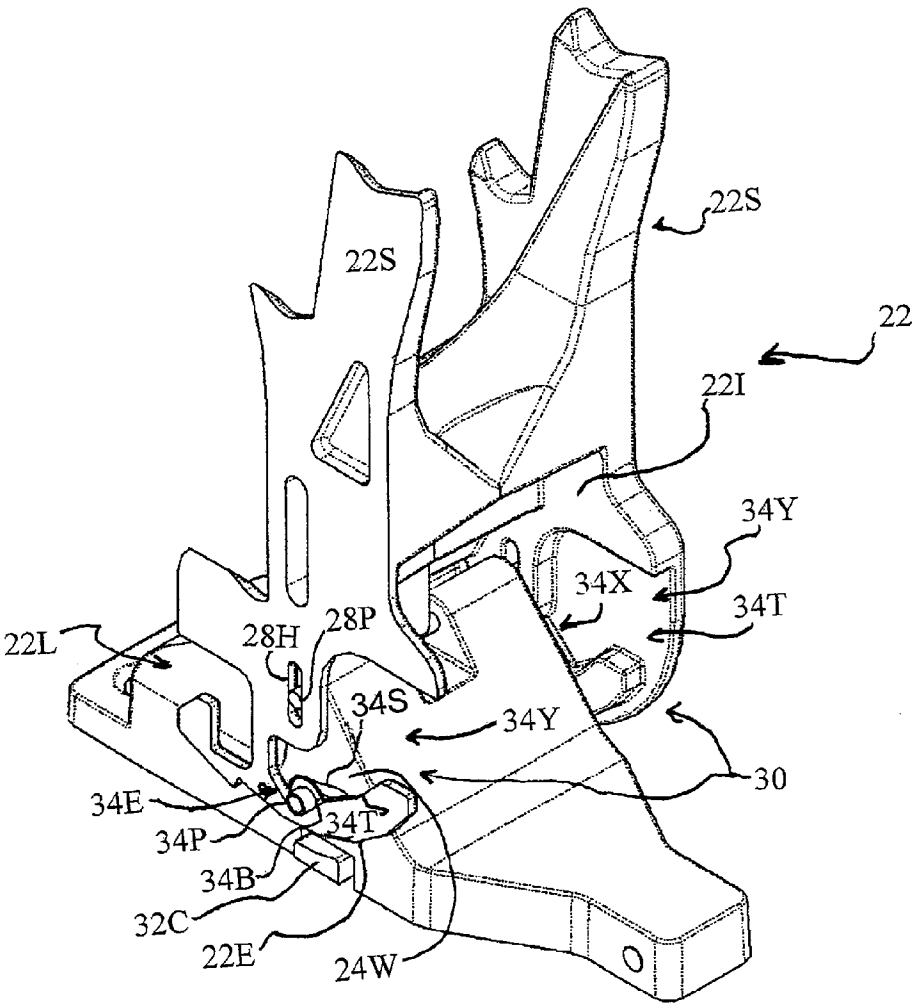
FIGS. 4 and 5 are isometric sectional side views of a tower assembly along sections B-B and A-A respectively.
Figure 5:
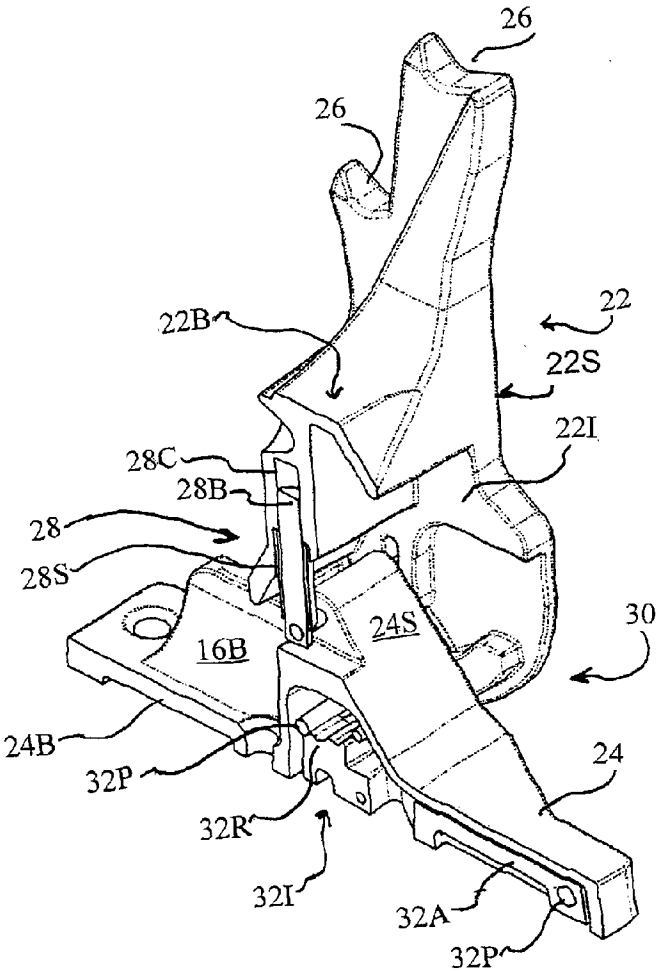

Referring to FIGS. 4 and 5, therein are respectively shown an isometric side view of a tower assembly 20 along sectional B-B and an isometric sectional side view of the tower assembly 20 taken generally along sectional plane A-A, that is, along the centerline axis of tower assembly 20.

B. Tower Pivot Mechanism 22 and Tower Base Assembly 24

As shown in FIGS. 4 and 5, tower pivot mechanism 22 includes first and second tower side wall structures 22S which extend generally vertically above tower base assembly 24 to either side of tower base assembly 24 with the lower ends of tower side wall structures 22S generally enclosing tower base assembly 24. The tower side wall structures 22S of tower pivot mechanism 22 are connected by a centrally located tower pivot body 22B, which is located above tower base assembly 24.

Tower base assembly 24, in turn, includes a generally flat tower base 24B, which is attached to the upper surface of the ski 14, and a tower pivot support 24S located along the central axis of tower base 24B and tower pivot body 22B and that extends above tower base 24B in the region generally beneath tower pivot body 22B. As illustrated, the forward side of tower pivot support 24S is generally vertical with respect to the plane of the ski 14 while the back side of tower pivot support 24S generally slopes downward and backward to the upper surface of tower base 24B. As will be seen in following descriptions and as may be seen from the figures, tower pivot support 24S is constructed as a generally hollow structure having front and rear walls, an upper wall, and side walls 24W, as shown in FIG. 4, thereby providing a space within for other mechanisms of the slope compensation mechanism 2, which will be discussed in detail below.

Lastly, in a presently preferred embodiment of a binding 10 and slope compensation mechanism 2 and as shown for example in FIGS. 1, 3A, 3B, 4 and 5, end cap adapter 16A located at the heel end 16H of beam 16 includes a rearwards projecting alignment boss 16B that in a present embodiment has a lower side that is curved transversely to axis Y of beam 16. The forward end of tower base 24B has a corresponding forward projecting alignment socket 24A having an upward facing recess that is curved transversely to axis Y of beam 16 in a manner so as to mate with the lower surface of alignment boss 16B. When binding 10 and slope compensation mechanism 2 are rotated into the downhill skiing mode, with beam 16 rotated downwards to lie along and parallel to the upper surface of ski 14, alignment boss 16B on end cap adapter 16A seats into the corresponding recess in alignment socket 24A of tower base 24B, thereby securing beam 16 into alignment and engagement with tower base 24B and preventing unwanted movement or heel end 16B of beam 16 and thereby keeping the boot 12 correctly aligned with the ski 14.

C. Resilient Pivot Mechanism 28

Referring to FIGS. 1, 3A, 3B, 4, 5 and 7A-7C, tower pivot mechanism 22 is pivotably and slidably mounted to tower base assembly 24 by means of a resilient pivot mechanism 28 that includes a tower pivot pin 28P that extends horizontally transversely through the upper region of tower pivot support 24S and extends outwards through both sidewalls 24W of tower pivot support 24S with the outer ends of tower pivots pin 28P extending into height adaptation slots 28H formed in the interior surfaces 22I of tower side wall structures 22S. Height adaptation slots 28H extend generally vertically along or parallel to the general vertical axis of tower pivot mechanism 22 and permit tower pivot mechanism 22 to move vertically with respect to tower base assembly 24 to the extent defined by the location and dimensions of height adaptation slots 28H. According to the present invention, the location and vertical extent of height adaptation slots 28H are such as to allow tower pivot mechanism 22 to move between a lowest position wherein the lower edge of tower pivot mechanism 22 bears against or nearly against the upper surface of tower base assembly and an uppermost position wherein end cap 16C and end cap adapter 16A rise above the uppermost of elevation angle catches 26 to thereby allow end cap 16 and end cap adapter 16A to engage with the uppermost of elevation angle catches 26. As indicated, and while height adaptation slots 28H extend into the interior surfaces 22I of tower side wall structures 22S, in presently preferred embodiments of the present invention height adaptation slots 22H do not extend through tower side wall structures 22S, thereby reducing the possibility of foreign substances, such as snow, ice, mud, dirt and sand, getting into the resilient pivot mechanism 28 and other functional elements of the binding 10 and slope compensation mechanism 2 of the present invention.

As shown, resilient pivot mechanism 28 further includes a resilient bias mechanism 28R which operates to resiliently bias tower pivot mechanism 22 upwards with respect to tower base assembly 24 for reasons that will become apparent after the following discussions of the present invention. In a presently preferred embodiment, resilient pivot mechanism 28 includes a bias piston 28B having a lower end pivoting on tower pivot pin 28P and an upper end extending into a bias cylinder 28C located in the lower end of tower pivot body 22B along the central axis of tower pivot mechanism 22 and tower base assembly 24 and, in a present embodiment, occupies a notch or space in the upper forward side of tower pivot support 24S, thereby allowing bias piston 28B and tower pivot mechanism 22 to rotate forwards with respect to tower pivot support 24S and tower base assembly 24 as the angle of tower pivot mechanism 22 and beam 16 adjust to the angle of slope being traversed by a skier. As shown, resilient pivot mechanism 28 further includes a bias spring 28S that, in a present embodiment of the invention, is a coil (compression) spring 28S surrounding the lower end of bias piston 28B and that bears against the lower side of tower pivot body 22B around the lower end of bias cylinder 28C and against the upper side of tower pivot support 24S in the region around the lower end of bias piston 28B, thereby resiliently urging tower pivot body 22B and thus tower pivot mechanism 22 upwards with respect to tower base assembly 24.

D. Slope Angle Mechanism 30

Tower pivot mechanism 22 is further coupled with tower base assembly 24 by means of a slope angle mechanism 30 which automatically adjusts the angle of tower pivot mechanism 22 with respect to tower base assembly 24 and thus the height of engagement between beam 16 and tower pivot mechanism 22 and thereby the angle of beam 16 with respect to tower base assembly 24 and the ski 14 according to the angle of a slope being traversed by the skier.

E. Clutch Mechanism 32

As shown in FIGS. 1, 3A, 3B, 4, 5, 6 and 7A-7C, slope angle mechanism 30 includes a clutch mechanism 32 having a resiliently biased angle indexer 32I that pivots on an indexer pivot pin 32P located at a rear end of an indexer arm 32A and has an angle index ratchet 32R located at the forward end of indexer arm 32A in a position generally beneath tower pivot support 24S and tower pivot pin 28P. The forward end of indexer arm 32A and the angle index ratchet 32R are located in the above described space or hollow in the lower region of tower pivot support 24S and indexer arm 32A extends toward the rear of tower base assembly 24 in a space or hollow thereof.

Clutch mechanism 32 further includes a first indexer bias pin 32X that extends horizontally and transversely through and is supported by sidewalls 24W of tower pivot support 24S in the space above indexer arm 32A, with first indexer bias pin 32X being located between angle index ratchet 32R and indexer pivot pin 32P and generally adjacent angle index ratchet 32R. A corresponding second indexer bias pin 32Y, or pair of second indexer bias pins 32Y, extend transversely from the sides of indexer arm 32A at a location generally parallel to and below first indexer bias pin 32X. First and second indexer bias extension springs 32S are connected between the corresponding ends of first and second indexer bias pins 32X and 32Y and exert a resilient upward force on second indexer bias pin 32Y to resiliently urge indexer arm 32A and thus angle index ratchet 32R in the upward direction with respect to tower pivot mechanism 22.

As indicated in FIGS. 1, 3A, 3B, 4, 5, 6 and 7A-7C, angle index ratchet 32R includes a plurality of upward facing ratchet notches 32N wherein each ratchet notch 32N corresponds to one of elevation angle catches 26 and thus to one of the slope adjustment angles of the tower assembly 20.

According to the present invention, and as will be described in detail next below, angle index ratchet 32R of clutch mechanism 32 interacts with a pendulum pin 34P of a pendulum mechanism 34 to capture and retain the position of the pendulum pin 34P during the operation of tower pivot mechanism 22 during a stride of the skier to in turn control the angle that is to be assumed between tower pivot mechanism 22 and tower base assembly 24 and thus angle the beam 16 and the ski 14 for a slope currently being ascended by the skier. The angle to be assumed between tower pivot mechanism 22 and tower base assembly 24 is determined by the one of the plurality of ratchet notches 32N of angle index ratchet 32R in which the pendulum pin 34P is captured and requires that angle index ratchet 32R of clutch mechanism 32 engage with and disengage from pendulum pin 34P of pendulum mechanism 34 at the appropriate points in the motion of tower pivot mechanism 22 during a skier's stride.

In general, the operation of clutch mechanism 32 and pendulum mechanism 34 requires that angle index ratchet 32R of clutch mechanism 32 be disengaged from the pendulum pin 34P when the skier's weight is fully upon beam 16 and thus upon tower pivot mechanism 22, and thus when the angle between beam 16 and the ski 14 is such that the ski 14 is parallel with the slope being ascended, so that the pendulum pin 34P may move to a position indicating the angle between the ski 14 and tower base assembly 24 and the vertical at that time. The operation of clutch mechanism 32 and pendulum mechanism 34 further requires that angle index ratchet 32R of clutch mechanism 32 engage with the pendulum pin 34P to capture the pendulum pin 34P in the corresponding one of ratchet notches 32N of angle index ratchet 32R as soon as possible when the skier's weight begins to come off of the beam 16 and tower pivot mechanism 22.

For this reason, and as described above, resilient pivot mechanism 28 is interposed between tower pivot mechanism 22 and tower base assembly 24 to permit tower pivot mechanism 22 to move axially and to pivot with respect to tower base assembly 24. Resilient pivot mechanism 28 thereby allows tower pivot mechanism 22 to move axially toward and away from tower base assembly 24 and angle index ratchet 32R of clutch mechanism 32 as the skier's weight is imposed upon and removed from the beam 16, and this capability allows angle index ratchet 32R to engage with and to disengage from the pendulum pin 34P as the skier's weight is imposed upon and removed from the beam 16.

Figure 6:
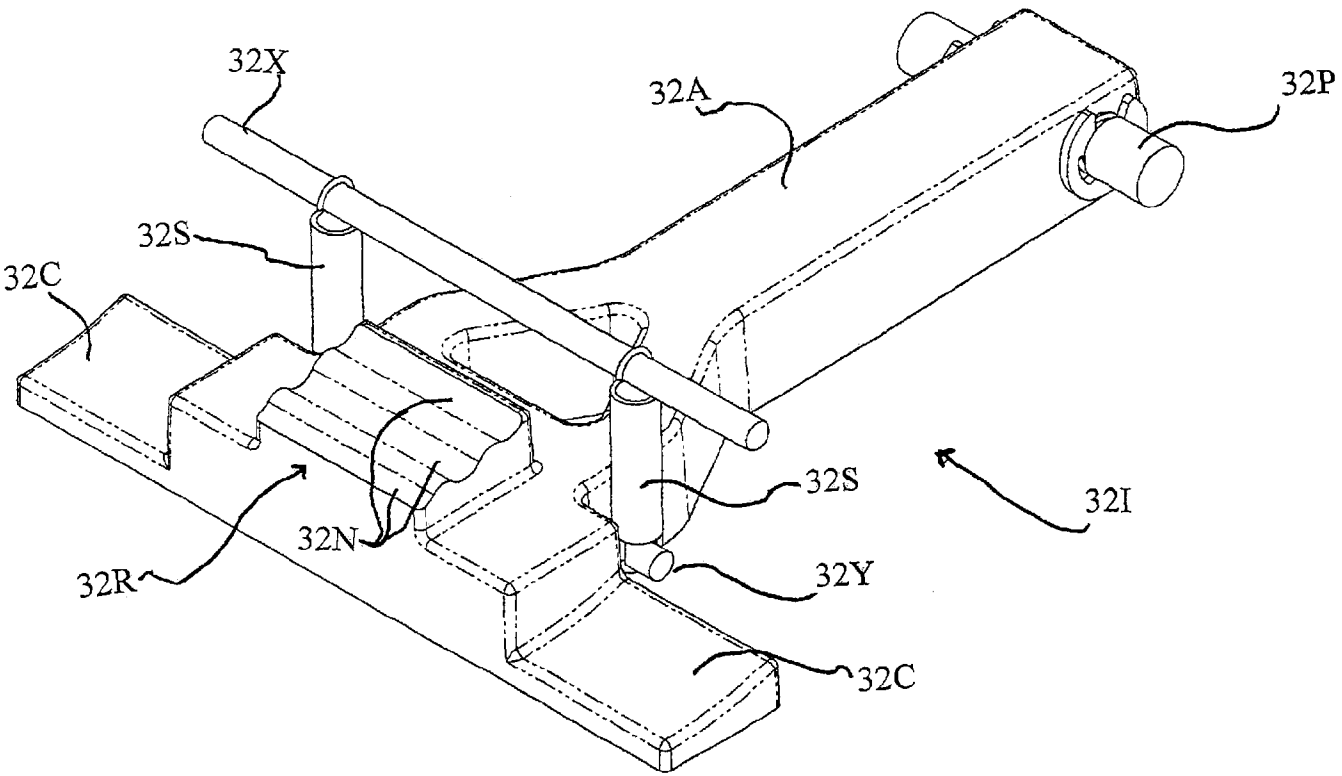
FIG. 6 is an isometric view of a portion of a slope angle mechanism.

In particular, and as illustrated in FIGS. 4 and 6 as well as in subsequent figures discussed below, clutch activation arms 32C extend from either side of the forward end of indexer arm 32A, that is, the end of indexer arm 32A away from indexer pivot pin 32P and adjacent angle index ratchet 32R. Tower pivot mechanism 22 correspondingly includes curved lower edges 22E of tower sidewall structures 22S which engage with and disengage from clutch activation arms 32C as tower pivot mechanism 22 is depressed toward or moves upward from tower base assembly 24 as the skier's weight is imposed upon and removed from the beam 16, thereby causing angle index ratchet 32R to disengage from or engage with pendulum pin 34P at the desired points during a stride by the skier.

F. Pendulum Mechanism 34

Figures 7A, 7D, 7E:
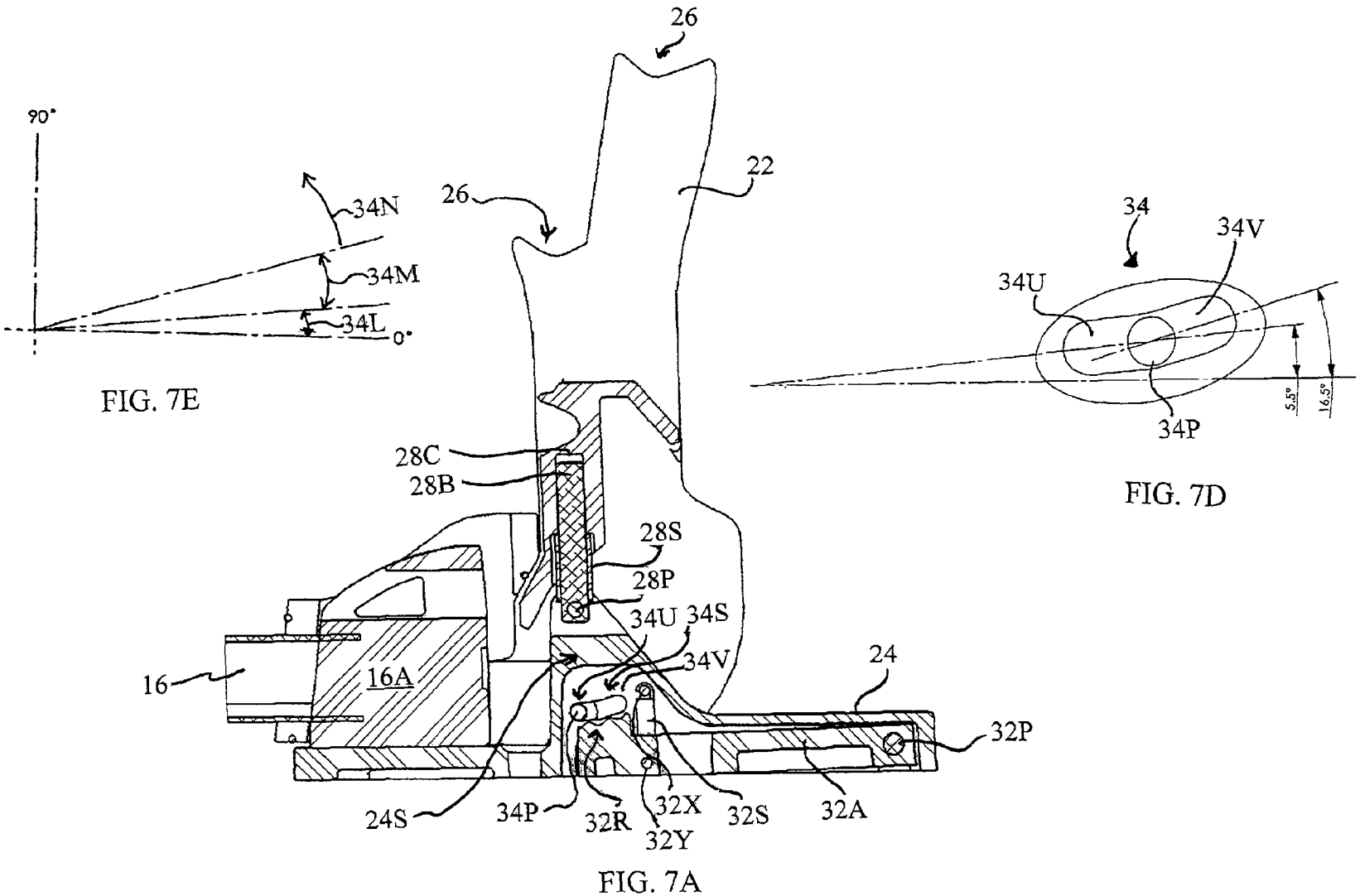
FIG. 7A is a sectional side view of a tower assembly taken along central axis sectional plane A-A.
FIG. 7D is an enlarged view of a pendulum slot comprised of a plurality of intersection linear segments.
FIG. 7E is a diagrammatic representation of three slope index angles.
Figure 7B:
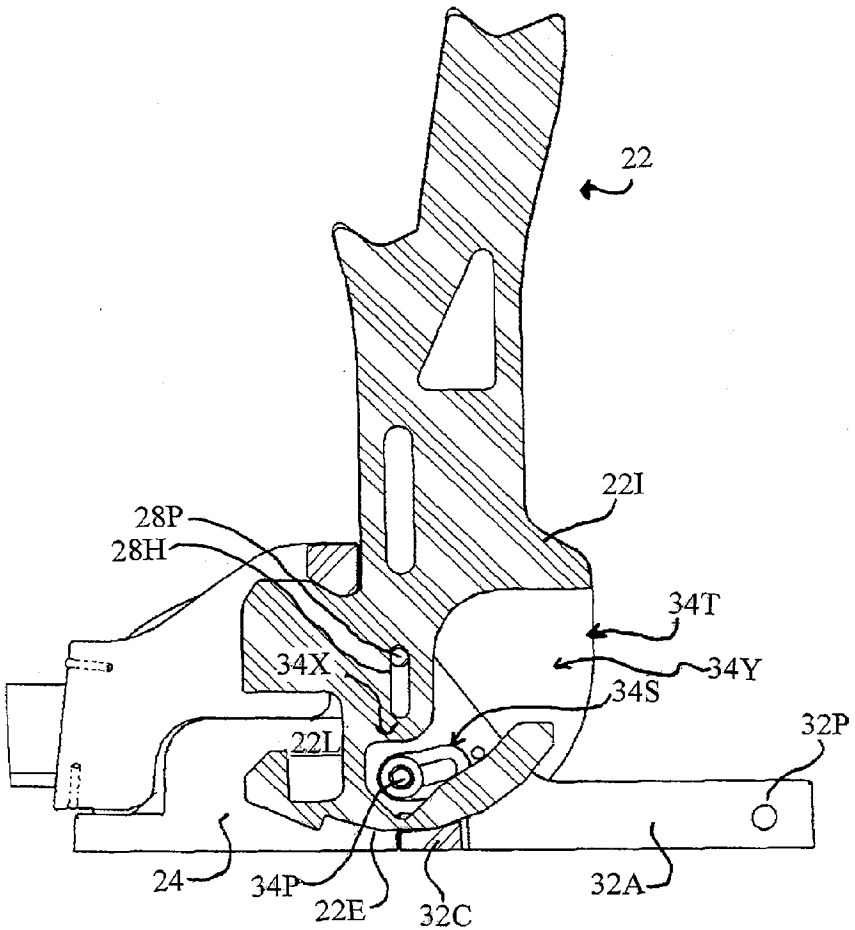
FIGS. 7B and 7C are sectional side views of a tower assembly taken along offset sectional plane B-B.
Figure 7C:
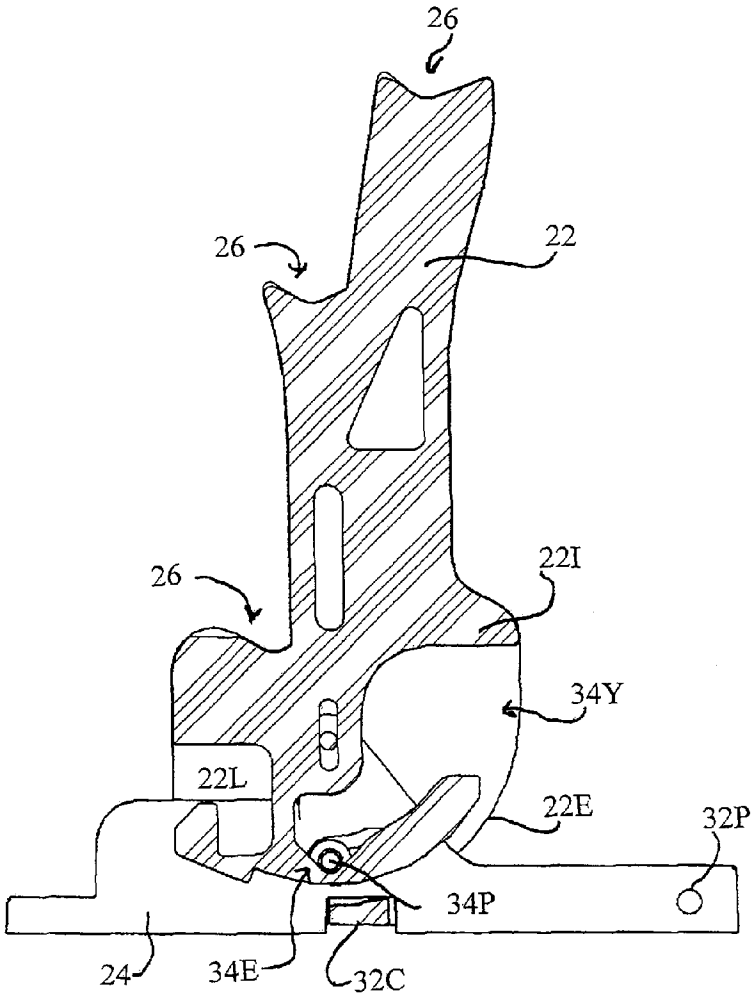
Figure 8A:
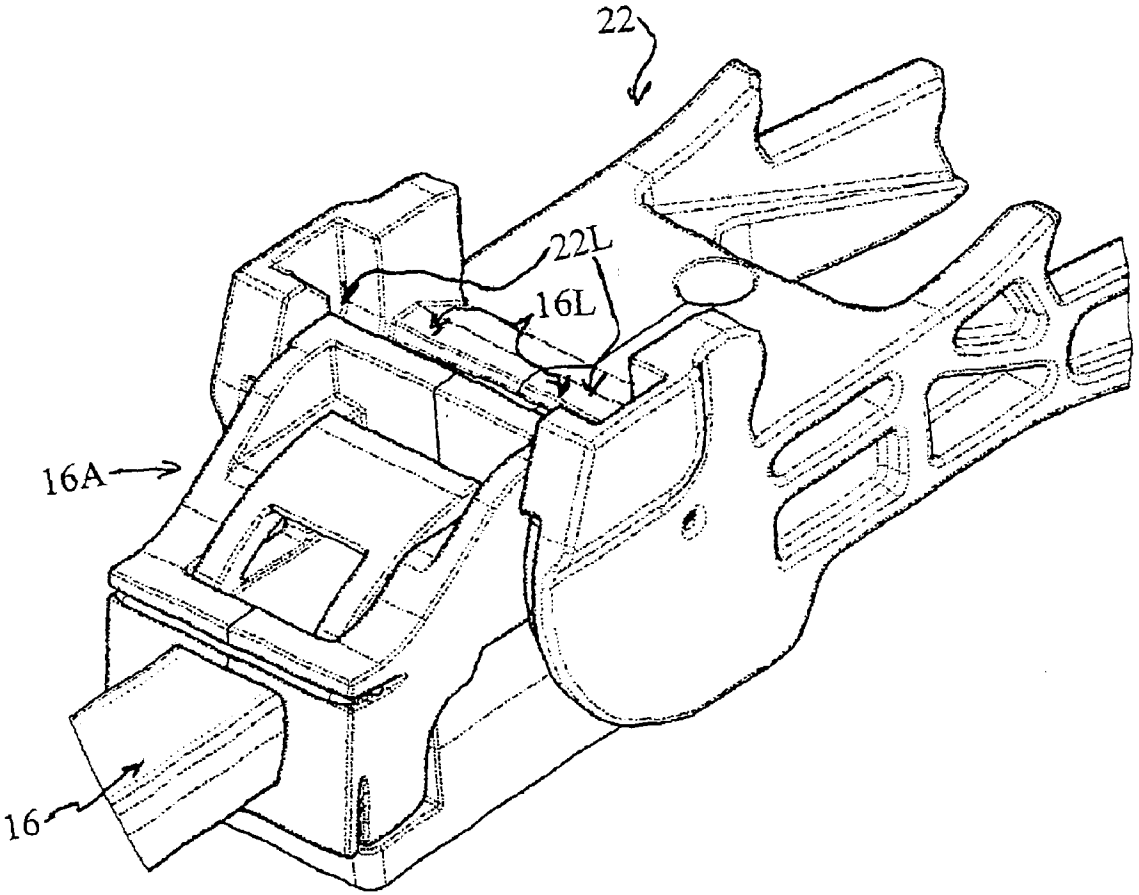
FIGS. 8A and 8B are respectively isometric and sectional side views of the binding in a locked or downhill skiing configuration.
Figure 8B:
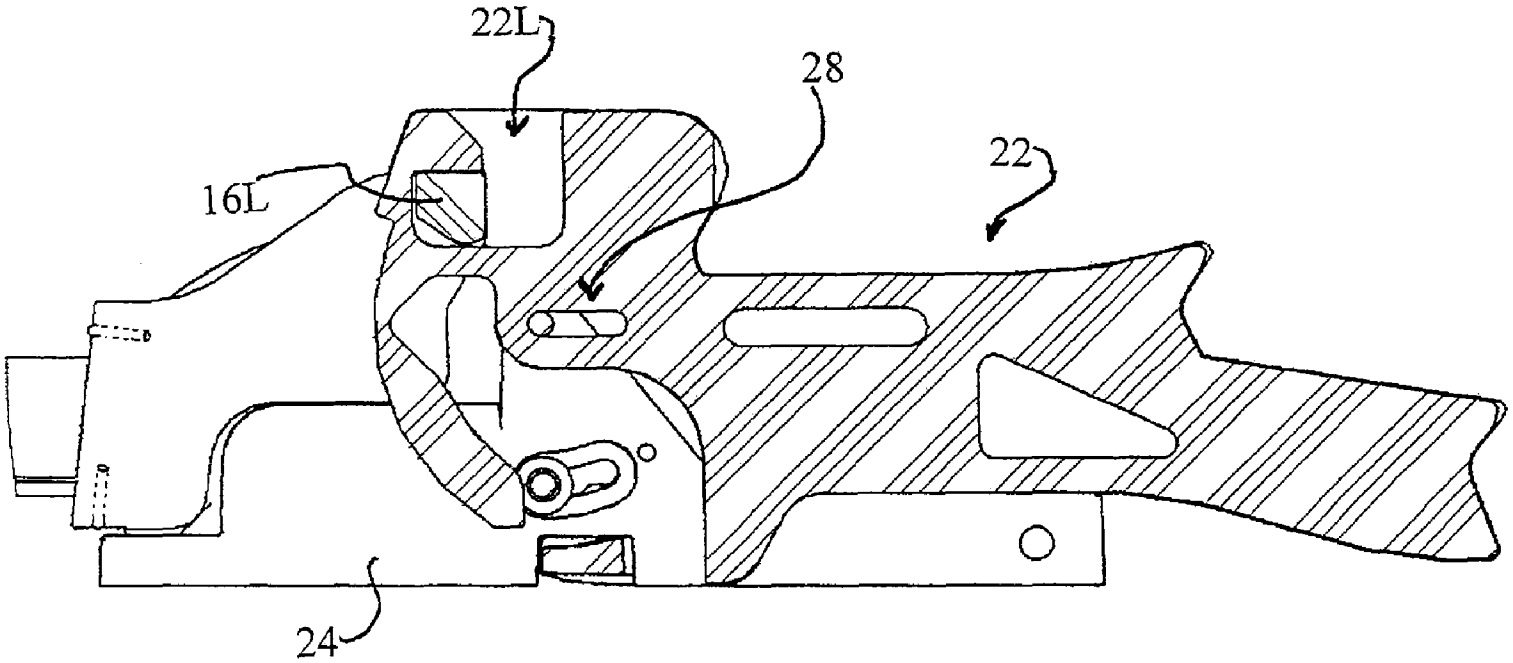

Referring to FIGS. 4 and 7A, 7B, 7C, 7D and 7E, therein are illustrated the elements and operation of pendulum mechanism 34 wherein, as discussed above, FIG. 4 is an isometric sectional side view of tower assembly 20 taken along sectional B-B and wherein FIG. 7A is a sectional side view of tower assembly 20 taken along sectional plane A-A, FIGS. 7B and 7C are sectional side view of tower assembly 20 taken along sectional B-B and FIG. 7D is an enlarged view of a part of FIG. 7A while FIG. 7E is a diagrammatic illustration of sloped index angles.

As shown in FIGS. 4, 7A, 7B, 7C, 7D and 7E, pendulum mechanism 34 includes a pendulum pin 34P extending horizontally and transversely through pendulum slots 34S in sidewalls 24W of tower pivot support 24S. As shown in FIG. 7A and in FIGS. 7D and 7E, which is an enlarged view of a pendulum slot 34S as shown in FIG. 7A, pendulum slots 34S are each comprised of intersecting first and second linear pendulum slot sections 34U and 34V wherein first linear pendulum slot section 34U comprises the front portion of a pendulum slot 34S and second linear pendulum slot section 34V comprises the rearward portion of a pendulum slot 34S. In a presently preferred embodiment of a slope compensation mechanism 2 first linear pendulum slot section 34U is inclined upward toward the intersection with second linear pendulum slot section 34V at an angle of 5.5 degrees relative to the base of tower base assembly 24 and thus to plane Y of the ski 14 while the second linear pendulum slot section 34V is inclined upward from the intersection with the first linear pendulum slot section 34U and toward the rear of the pendulum slot 34S at an angle of 16.5 degrees relative to the base of tower base assembly 24 and thus to the plane Y of the ski 14. It will be noted that the two angles of the pendulum slot sections 34U and 34V thereby correspond to the first, second and third slope index angles 34L, 34M and 34N and thus slope angle ranges 0 degrees to 5.5 degrees, 5.5 degrees to 16.5 degrees and of angles greater than 16.5 degrees accommodated by present embodiments of a slope compensation mechanism 2. That is, and more specifically, pendulum pin 34P will assume at position at the forward end of first pendulum slot section 34U when the angle of the slope is equal to or less than 5.5 degrees, so that the forward end of first pendulum slot section 34U corresponds to first slope index angle 34L. Pendulum pin 34P will assume a position at the intersection of first pendulum slot section 34V when the angle of the slope is between 5.5 and 16.5 degrees, thereby corresponding to second pendulum index slope angle 34M, and will assume a position at the rear end of second pendulum slot section 34V when the angle of the slope is 16.5 degrees or greater, thereby corresponding to the third pendulum index slope angle 34N.

The design of pendulum slots 34S as intersecting segments of straight slots at angles relative to the horizontal corresponding to the ranges of slope angles accommodated by a slope compensation mechanism 2 provides three distinct positions along a pendulum slot 34 that may be assumed by pendulum pin 34P during a skier's stride, which inhibits or reduces undesirable swinging of pendulum pin 34P when the skier's weight is imposed on tower pivot mechanism 22 and pendulum pin 34P is free to move, as described in detail in a following discussion. As described above, pendulum pin 34P will assume the first position, which is at the front of each pendulum slot 34S, that is, at the front end of first linear pendulum slot section 34U, when the plane X of the ski 14 is close to horizontal, as when the skier is moving along a flat surface, down a sloping surface or across rather than up a sloping surface. Pendulum pin 34P will assume a position the intersection of first linear pendulum slot section 34U and second linear pendulum slot section 34V when the plane X of the ski 14 is at an angle of between 5.5 degrees and 16.5 degrees relative to the horizontal, such as +11 degrees, as when the skier is ascending a moderate slope. Lastly, pendulum pin 34P will assume a position at the rear end of second linear pendulum slot section 34V when the plane X of the ski 14 is at an angle of 16.5 degrees or greater relative to the horizontal, as when the skier is ascending a steeper slope.

It will also be noted that during at least a part of a stride when a skier's weight is imposed on the pendulum slots 34S are of a width sufficient to closely accommodate pendulum pin 34P while allowing pendulum pin 34P to freely traverse pendulum slots 34S. As may be seen in FIG. 4, and as generally shown in FIGS. 7A, 7B and 7C, the ends of pendulum pin 34P extend horizontally outward and into tower engagement slots 34T formed in the interior surfaces 22I of tower side wall structures 22S so that pendulum pin 34P is retained in pendulum slots 34S by the inner faces of tower engagement slots 34T.

As also shown in FIGS. 4, 7A, 7B and 7C, each end of pendulum pin 34P may be provided with, for example, a washer and bushing 34B. In addition, and as in the case of height adaptation slots 28H, in a presently preferred embodiment tower engagement slots 34T do not extend through tower side wall structures 22S, thereby reducing the possibility of foreign substances, such as snow, ice, mud, dirt and sand, getting into the resilient pivot mechanism 28 and other functional elements of the slope compensation mechanism 2 of the present invention.

As may be seen in FIGS. 4, 7A, 7B and 7C, a first part 34X of each tower engagement slot 34T that is located toward the front of the tower engagement slot 34T, which is curved along a curve centered on tower pivot pin 28P and extends in a generally horizontal orientation. A second, rearward part 34Y of each tower engagement slot 34T, however, is widened and extends to the outer edge of each corresponding tower side walls structure 22S to allow tower pivot pin 34P to engage with and disengage from tower engagement slots 34T when tower pivot mechanism 22 is rotated into the downhill skiing position wherein, as will be described in a following description of this mode of operation of the binding 10 and slope compensation mechanism 2, tower pivot mechanism 22 is rotated backwards around tower pivot pin 28P to a position generally parallel with the plane of the ski 14.

As also shown in FIGS. 4, 7A, 7B and 7C, the lower edge of front part 34X of each tower engagement slot 34T is formed into a tower angle notch 34E having sloping sides and an axis and apex that is generally radially aligned with height adaptation slots 28H and tower pivot pin 28P. Each tower angle notch 34E thereby points radially outward with respect to tower pivot pin 28P and thus with respect to pendulum pin 34P, that is, each tower angle notch 34E points downwards when tower pivot mechanism 22 is oriented in the generally vertical direction. As shown, the angular width of each tower angle notch 34E at the intersection of the sloping sides of the tower angle notch 34E with the curved outer edge of the tower engagement slot 34T is such as to encompass the movement of pendulum pin 34P along pendulum slot 34S as pendulum pin 34P moves from either the bottom to the middle of pendulum slot 34S or from middle to the top of pendulum slot 34S during a skier's stride.

G. Operation of a Binding 10 and Slope Compensation Mechanism 2 in Cross Country Mode The following will next describe and discuss the cooperative operation of tower pivot mechanism 22 and tower base assembly 24 as a skier traverses a sloping surface, including the operation of resilient pivot mechanism 28 and slope angle adaptation mechanism 30, including pendulum mechanism 34 and clutch mechanism 32

First considering the operation of resilient pivot mechanism 28, and referring to FIGS. 1, 3A, 3B, 4, 5 and 7A-7C, resilient pivot mechanism 28 includes tower pivot pin 28P which slides in height adaptation slots 28H and allows tower pivot mechanism 22 to move towards and away from tower base assembly 24 over the range allowed by height adaptation slots 28H while pivoting about tower pivot pin 28P over the range of angles required for end cap adapter 16A to mate with each of the elevation angle catches 26 of tower pivot mechanism 22.

Resilient bias mechanism 28R of resilient pivot mechanism 28, in turn, and as described above, includes bias piston 28B, bias cylinder 28C and bias compression spring 28S acting between tower pivot pin 28P and tower pivot body 22B. As described, resilient bias mechanism 28R resiliently biases tower pivot mechanism 22 in the direction away from tower pivot pin 28P in tower base assembly 24, that is, in the generally upward direction and thus away from pendulum pin 34P, which is mounted in pendulum slots 34S in tower pivot support 24S. The resilient force exerted by resilient bias mechanism 28R to resiliently urge tower pivot mechanism 22 away from pendulum pin 34P may be overcome during a skier's stride, however, by the weight of the skier imposed on beam 16 and thus onto tower pivot mechanism 22 through engagement of the beam 16 with an elevation angle catch 26 of tower pivot mechanism 22.

According to the present invention, therefore, the imposition and removal of the skier's weight on the beam 16 and thus on the tower pivot mechanism 22 through elevation angle catches 26 during a striding motion of the skier will respectively cause tower pivot mechanism 22 to be moved toward pendulum pin 34P against the resilient force exerted by resilient bias mechanism 28R when the weight is removed and to move away from pendulum pin 34P when the weight is imposed.

Next considering the interaction of pendulum mechanism 34 with clutch mechanism 32 of slope angle adaptation mechanism 30, and referring again to FIGS. 1, 3A, 3B, 4, 5 and 7A-7C, it has been described above that pendulum slots 34S are of a width sufficient to closely accommodate pendulum pin 34P while allowing pendulum pin 34P to freely traverse pendulum slots 34S, that is, to move backwards and forwards along pendulum slots 34S. When pendulum pin 34P is free to move along pendulum slots 34S, therefore, such as when the ski 14 is in contact with the surface the skier is traversing and the skier's weight is imposed on beam 16 and tower pivot mechanism 22, pendulum slots 34S will assume an orientation reflecting the slope of that surface and pendulum pin 34P will move along pendulum slots 34S to the lowest position thereof with respect to the vertical axis as represented by gravitational force, so that the position of pendulum pin 34P will at that time represent the slope of the surface being traversed.

Clutch mechanism 32 interacts with pendulum mechanism 34, and in particular with pendulum pin 34P, to mechanically capture and store the position of pendulum pin 34P along pendulum slots 34S at that point during a skier's stride when the position of pendulum pin 34P represents the slope of the surface being traversed, that is, at that point during the skier's stride when the weight of the skier first begins to come off of tower pivot mechanism 22.

That is and as described above, the imposition of the skier's weight onto tower pivot mechanism 22 through the beam 16 and elevation angle catches 26 during a first part of a skier's stride will have forced tower pivot mechanism 22 downwards against the force of resilient bias mechanism 28R so that curved lower edges 22E of tower sidewall structures 22S bear against clutch activation arms 32C, thereby disengaging angle index ratchet 32R from pendulum pin 34P so that pendulum pin 34P is free to move along pendulum slots 34S. When the skier's weight is removed from tower pivot mechanism 22 at the start of a second part of the skier's stride, and the angle of the slope being traversed is to be captured, resilient bias mechanism 28R moves tower pivot mechanism 22 in the direction away from pendulum pin 34P so that curved lower edges 22E of tower sidewall structures 22S become disengaged from clutch activation arms 32C, thereby allowing angle index ratchet 32R to engage with pendulum pin 34P. Pendulum pin 34P will thereby be captured in the one of ratchet notches 32N of angle index ratchet 32R most closely corresponding to the angle of the slope being traversed, thereby capturing and storing an indication of the angle of the slope being traversed.

Next considering the interaction of pendulum mechanism 34 with tower pivot mechanism 22, as described and as shown in FIGS. 1, 3A, 3B, 4, 5 and 7A-7C, resilient bias mechanism 28R resiliently urges tower pivot mechanism 22 away from pendulum pin 34P so that the outer edge of each tower engagement slot 34T and thereby tower angle notches 34E are resiliently urged toward engagement with pendulum pin 34P. When the skier's weight is imposed on beam 16 during the first part of the skier's stride, however, and thus onto tower pivot mechanism 22 through an elevation angle catch 26, the force imposed by the skier's weight overcomes the resilient bias force exerted by resilient bias mechanism 28R, thus forcing tower pivot mechanism 22 toward pendulum pin 34P so that tower angle notches 34E are disengaged from pendulum pin 34P. Pendulum pin 34P is then free to move along pendulum slots 34S as urged by gravity and will move to a position along pendulum slots 34S that corresponds to the angle of the slope currently being traversed by the skier. As described just above, the movement of tower pivot mechanism 22 toward pendulum pin 34P when the skier's weight is imposed on tower pivot mechanism 22 during the first part of the skier's stride likewise, and at the same time, disengages angle index ratchet 32R or clutch 32 from pendulum pin 34P so that the movement of pendulum pin 34P along pendulum slots 34S is not restrained by clutch 32.

At the start of the second part of the skier's stride, when the skier's weight is first removed from tower pivot mechanism 22 and the resilient force exerted by resilient bias mechanism 28R urges tower pivot mechanism 22 in the direction away from pendulum pin 34P, the movement of tower pivot mechanism 22 will bring the lower edge of tower engagement slots 34T with tower angle notches 34E into contact with pendulum pin 34P. As described, the width of tower angle notches 34E at their intersection with the lower edge of tower engagement slots 34T is sufficient that pendulum pin 34P will become engaged with the sloping sides of tower engagement slots 34T at some point across the width of tower engagement slots 34T at any of the angles of rotation that tower pivot mechanism 22 may assume with respect to tower pivot pin 28P.

As a result, the interaction between pendulum pin 34P and the sloping sides of tower angle notches 34E resulting from the resilient force away from pendulum pin 34P that is exerted on tower pivot mechanism 22 by resilient bias mechanism 28R will cause tower pivot mechanism 22 to rotate about tower pivot pin 28P until pendulum pin 34P is located at the apexes of tower angle notches 34E. At this point, tower pivot mechanism 22, and the elevation angle catches 26, have been rotated forward relative to tower base 24 and the ski 14 by an angle determined by the angle of the slope currently being ascended by the skier. This angle of rotation of tower pivot mechanism 22 will be maintained by the action of clutch 32 and pendulum mechanism 34 until the end of the next occurring first part of the skier's stride, when the skier's weight is again imposed on tower pivot mechanism 22.

It will be apparent that during the second part of the skier's stride beam 16 will continue to rotate forwards about toe base 18 to a final forward rotation angle and that during this forward rotation end cap 16C and end cap adapter 16A will disengage from the current one of elevation angle catches 26 of tower pivot mechanism 22. The motion of the skier's foot will then begin to rotate beam 16 backwards toward tower pivot mechanism 22 at the start of the next first part of the skier's stride, while tower pivot mechanism 22 continues to be held in the angle of rotation corresponding to the angle of the slope currently being ascended. At some point in the backward rotation of beam 16 during this next first part of the skier's stride end cap 16C and end cap adapter 16A of beam 16 engage with the one of the elevation angle catches 26 corresponding to the angle of the slope currently being ascended, as determined by the rotation of tower pivot mechanism 22 about tower pivot pin 18P as determined by pendulum mechanism 34. At this point, beam 16 and the skier's foot will be approximately horizontal, due to the angle relative to the ski 14 at which beam 16 is held by the currently active elevation angle catch 26, and the skier's weight is once again imposed on tower pivot mechanism 22, thereby once again initiating the above described cycle of operations.

H. Operation of a Binding 10 and Slope Compensation Mechanism 2 in Downhill Skiing Mode Lastly considering the operation of a binding 10 and slope compensation mechanism 2 during downhill skiing, as shown in FIGS. 1, 2, 3A, 8A and 8B, end cap adapter 16A includes a pair of adapter lock arms 16L extending outwards from either side of end cap adapter 16A at the end of end cap adapter 16A adjacent tower pivot mechanism 22 and tower base assembly 24. It is also shown in FIGS. 1, 2, 3A and 4 that the inner surfaces 22I of tower sidewall structures 22S each include a downhill lock 22L. In a present embodiment, downhill lock 22 is comprised of a generally L-shaped slot having a first section by which an adapter arm 16L may be engaged with the downhill lock 22L and a second section, at a right angle to the first, in which the adapter lock arm 16L is retained when the downhill lock 22L is in the locked position. As will be apparent from the figures, adapter lock arms 16L may be engaged into downhill lock 22L as tower pivot mechanism 22 is rotated from a generally vertical position, shown in FIGS. 1, 2, 3A and 4, into the locked position in which tower pivot mechanism 22 is fully rotated to the rear of binding 10, thereby securing adapter lock arms 16L into the slots of downhill lock 22L and thereby securing beam 16 in a position adjacent to and parallel to the ski 14.

Since certain changes may be made in the above described method and system without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A slope compensation mechanism for automatically adapting an angle between a mounting beam, for supporting a ski boot, and a plane of a ski to a terrain being traversed by a skier wherein the mounting beam is rotatably pivoted to the ski at a toe end of the mount beam so that a heel end of the mounting beam is rotatable upward and downward about the pivoted toe end of the mounting beam during a stride of the skier, the slope compensation mechanism comprising:

a tower mechanism including:

a tower base assembly mounted to the ski and a tower pivot mechanism rotatably and slidably mounted to the tower base assembly, a resilient pivot mechanism acting between the tower base assembly and the tower pivot mechanism and allowing the tower pivot mechanism to rotate and to axially move with respect to the tower base assembly during the stride of the skier, the tower pivot mechanism including a plurality of elevation angle catches for engaging with the heel end of the mounting beam, each of plurality of elevation angle catches corresponding to one of a set of slope index angles corresponding to a range of angles of the terrain being traversed by the skier wherein a desired one of the plurality of elevation angle catches, engaged by the heel end of the mounting beam during a stride, is determined by the angle of the terrain being traversed, and a slope angle adaptation mechanism acting between the tower base assembly and the tower pivot mechanism for determining the slope index angle corresponding to the terrain being traversed and maintaining the tower pivot mechanism at the slope index angle during at least a part of a stride when a weigh of the skier is imposed on the tower pivot mechanism.

2. The slope compensation mechanism of claim 1, wherein:

the tower pivot mechanism includes first and second tower sidewall structures connected by a tower pivot body, and the tower base assembly includes a tower base attachable to an upper surface of the ski and a tower pivot support extending above the tower base and beneath the tower pivot body.

3. The slope compensation mechanism of claim 2, wherein the resilient pivot mechanism comprises:

height adaptation slots located on an interior surface of and extending parallel to a vertical axis of the tower sidewall structures of the tower pivot mechanism, and a tower pivot pin extending transversely with respect to and supported by the tower pivot support with ends of the tower pivot pin engaging in the height adaptation slots, the tower pivot pin and the height adaptation slots allowing the tower pivot mechanism to rotate with respect to the tower pivot support and to move axially between a lowest and a highest tower pivot mechanism location, and a resilient bias mechanism, including:

a bias piston having a lower end pivoting on the tower pivot pin and an upper end extending into a bias cylinder located in tower pivot body, and a bias spring engaged between the tower pivot body and the bias piston and resiliently biasing the tower pivot mechanism upward, whereby the tower pivot mechanism is urged resiliently upward with respect to the tower base assembly during a part of a stride of the skier, when the weight of the skier is removed from the tower pivot mechanism, and is moved downward toward the tower base assembly, when the weight of the skier is imposed on the tower pivot mechanism.

4. The slope compensation mechanism of claim 2, wherein the slope adaptation mechanism comprises:

a pendulum mechanism for determining the slope index angle corresponding to the terrain being traversed, including pendulum slots extending through horizontally and transversely through the tower pivot support and generally centered on the tower pivot pin, tower engagement slots formed in the interior surface of the tower sidewall structures, and a pendulum pin extending horizontally and transversely through the pendulum slots and engaging into the tower engagement slots in the tower sidewall structures, the pendulum pin being movable along the pendulum slots to assume a position along the pendulum slots corresponding with an angle of the terrain being traversed, each pendulum slot including a tower angle notch located in a lower side of the pendulum slot, each tower angle notch having sloping sides and an apex oriented away from and radially aligned with the tower pivot pin and a width at the pendulum slot corresponding to at least a movement of the pendulum pin along the pendulum slots corresponding to sequentially adjacent index angles, whereby upward movement of the tower pivot mechanism by the resilient bias mechanism when the weight of the skier is removed from the tower pivot mechanism will cause engagement of the tower angle notch sides with the pendulum pin and rotation of the tower pivot mechanism to the slope index angle relative to the tower base assembly corresponding to the angle of the terrain being traversed.

5. The slope compensation mechanism of claim 4, wherein the slope adaptation mechanism includes:

a clutch mechanism located in the tower base assembly, the clutch mechanism being actuated by upward movement of the tower pivot mechanism by the resilient bias mechanism when the weight of the skier is removed from the tower pivot mechanism to engage and restrain the pendulum pin at a position along the pendulum slots corresponding to the slope index angle, and being deactuated by downward movement of the tower pivot mechanism, against the resilient bias mechanism, when the weight of the skier is imposed on the tower pivot mechanism to disengage from the pendulum pin and allow movement of the pendulum pin along the pendulum slot.

6. The slope compensation mechanism of claim 5, wherein the clutch mechanism comprises:

a clutch surface resiliently biased in an upward direction toward the pendulum pin, an angle index ratchet mounted on the clutch surface for engaging with and restraining the pendulum pin, and at least one clutch actuation surface engaged by a lower surface of the tower structure to deactuate the clutch mechanism when the tower pivot mechanism is moved downward, against the resilient force of the resilient bias mechanism, when the weight of the skier is imposed on the tower pivot mechanism

7. The slope compensation mechanism of claim 4, wherein each pendulum slot comprises:

a plurality of sequentially intersecting linear pendulum slot sections having successive upward angles relative to a plane of the ski corresponding to successive ones of the plurality of the index slope angles.

8. The slope compensation mechanism of claim 7, wherein the plurality of linear pendulum slot angles includes at least a first linear pendulum slot section extending upward relative to the plane of the ski at an angle corresponding to a first one of the plurality of the index slope angles and a second linear pendulum slot section extending upward relative to the plane of the ski at an angle corresponding to a second one of the plurality of the index slope angles.

9. The slope compensation mechanism of claim 2, wherein the slope adaptation mechanism comprises:

a pendulum mechanism for determining the slope index angle corresponding to the terrain being traversed, including pendulum slots extending through horizontally and transversely through the tower pivot support and generally centered on the tower pivot pin, tower engagement slots formed in the interior surface of the tower sidewall structures, and a pendulum pin extending horizontally and transversely through the pendulum slots and engaging into the tower engagement slots in the tower sidewall structures, the pendulum pin being movable along the pendulum slots to assume a position along the pendulum slots corresponding with an angle of the terrain being traversed, each pendulum slot including a tower angle notch located in a lower side of the pendulum slot, each tower angle notch having sloping sides and an apex oriented away from and radially aligned with the tower pivot pin and a width at the pendulum slot corresponding to at least a movement of the pendulum pin along the pendulum slots corresponding to sequentially adjacent index angles, whereby upward movement of the tower pivot mechanism by the resilient bias mechanism when the weight of the skier is removed from the tower pivot mechanism will cause engagement of the tower angle notch sides with the pendulum pin and rotation of the tower pivot mechanism to the slope index angle relative to the tower base assembly corresponding to the angle of the terrain being traversed, and a clutch mechanism located in the tower base assembly, the clutch mechanism being actuated by upward movement of the tower pivot mechanism by the resilient bias mechanism when the weight of the skier is removed from the tower pivot mechanism to engage and restrain the pendulum pin at a position along the pendulum slots corresponding to the slope index angle, and being deactuated by downward movement of the tower pivot mechanism, against the resilient bias mechanism, when the weight of the skier is imposed on the tower pivot mechanism to disengage from the pendulum pin and allow movement of the pendulum pin along the pendulum slot.

10. The slope compensation mechanism of claim 9, wherein each pendulum slot comprises:

a plurality of sequentially intersecting linear pendulum slot sections having successive upward angles relative to a plane of the ski corresponding to successive ones of the plurality of the index slope angles.

11. The slope compensation mechanism of claim 10, wherein the plurality of linear pendulum slot angles includes at least a first linear pendulum slot section extending upward relative to the plane of the ski at an angle corresponding to a first one of the plurality of the index slope angles and a second linear pendulum slot section extending upward relative to the plane of the ski at an angle corresponding to a second one of the plurality of the index slope angles.

12. The slope compensation mechanism of claim 9, wherein the clutch mechanism comprises:

a clutch surface resiliently biased in an upward direction toward the pendulum pin, an angle index ratchet mounted on the clutch surface for engaging with and restraining the pendulum pin, and at least one clutch actuation surface engaged by a lower surface of the tower structure to deactuate the clutch mechanism when the tower pivot mechanism is moved downward, against the resilient force of the resilient bias mechanism, when the weight of the skier s imposed on the tower pivot mechanism.

13. A slope compensation mechanism for automatically adapting an angle of a mounting beam, for supporting a ski boot, with respect to a plane of a ski as a skier traverses a terrain, a toe end of the mounting beam being rotatably pivoted to the ski while a heel end of the mounting beam being is rotatable upward away from the ski and downward toward the ski, about the pivoted toe end, during a stride of the skier, the slope compensation mechanism comprising:

a tower mechanism including:

a tower base assembly mounted to the ski adjacent the heel end of the mounting beam, and a tower pivot mechanism rotatably and slidably mounted to the tower base assembly, a resilient pivot mechanism acting between the tower base assembly and the tower pivot mechanism and allowing the tower pivot mechanism to rotate and move axially with respect to the tower base assembly during the stride of the skier, the tower pivot mechanism including a plurality of elevation catches for engaging with the heel end of the mounting beam, each of plurality of elevation catches corresponding to one of a set of slope index angles corresponding to a range of angles to be traversed by the skier, and a slope angle adaptation mechanism, acting between the tower base assembly and the tower pivot mechanism, for determining the slope index angle corresponding to the terrain being traversed and maintaining the tower pivot mechanism at the slope index angle during at least a part of a stride when a weigh of the skier is imposed on the tower pivot mechanism.

* * * * *